United States Patent [19]

Bacroix et al.

[11] Patent Number: 4,787,427

[45] Date of Patent: Nov. 29, 1988

[54] APPARATUS FOR FILLING CONTAINERS USING COUNTERPRESSURE

[75] Inventors: Marcel Bacroix, Givry; Claude Toubhans, Bry sur Marne, both of France

[73] Assignee: Societe Dite: SEVA, Chalon sur Saone, France

[21] Appl. No.: 3,333

[22] Filed: Jan. 13, 1987

[30] Foreign Application Priority Data

Jan. 15, 1986 [FR] France ..... 86 00591

[51] Int. Cl.[4] ..... B67C 3/06

[52] U.S. Cl. ..... 141/39; 141/46; 141/198

[58] Field of Search ..... 141/1-12, 141/37-66, 83, 140, 156, 94, 95, 96, 192, 193, 197, 198

[56] References Cited

U.S. PATENT DOCUMENTS

| | | | |
|---|---|---|---|
| 2,063,326 | 12/1970 | Meyer | 141/39 |
| 3,604,480 | 9/1971 | Rehborn et al. | 141/39 |
| 3,779,293 | 12/1973 | Kaiser | 141/39 |
| 3,981,335 | 9/1976 | Peters | 141/46 |
| 4,223,699 | 9/1980 | Wilder et al. | 141/206 X |
| 4,360,045 | 11/1982 | Alhers | 141/39 |
| 4,369,820 | 1/1983 | Alhers et al. | 141/39 |
| 4,644,981 | 2/1987 | Bernhard | 141/39 |

FOREIGN PATENT DOCUMENTS 2075635 10/1971 France .

*Primary Examiner*—Henry J. Recla
*Assistant Examiner*—Ernest G. Cusick
*Attorney, Agent, or Firm*—Sughrue, Mion, Zinn, Macpeak and Seas

[57] ABSTRACT

A filling apparatus operating by counterpressure and intended for use on bottling or filling machines for a barrel 1 equipped with an electric sensor 2 for controlling the fill level of the containers, and connected to a solenoid valve E and supply tank B filled with liquid under gaseous pressure, as well as to a detector P that senses the proximity of the container C to be filled. Barrel 1 of filling apparatus A contains a chamber 11 which, when no container C is being applied against the filling apparatus, is divided by two flexible membranes 5, 6–72 into three successive annular chambers 69, 70, 71 separated by the dividing walls 58, 62–621 of the two membranes 5, 6–72.

8 Claims, 6 Drawing Sheets

APPARATUS FOR FILLING CONTAINERS USING COUNTERPRESSURE

BACKGROUND OF THE INVENTION

This invention is a filling device for use on machines designed to fill containers using counterpressure.

French Pat. No. 2,075,635 discloses filling means using counterpressure in which the filling and cut-off operations are controlled using a course control switch and an electric sensor.

In this device, as the bottle to be filled is moved into place, it makes contact with the seal gasket of a vertically movable centering hub. As the bottle continues to rise, the hub activates a course control switch. The latter, connected electrically to a solenoid valve, activates the solenoid, which then creates a pressure differential between two opposing surfaces of a vertically sliding sleeve. This causes the sleeve to rise, exposing an annular orifice through which pressurized gas from a filling tank enters the bottle to be filled, thereby pressurizing it. When the bottle is at the same pressure as the filling tank, a second sliding sleeve rises and exposes a second annular orifice through which the liquid to be bottled flows into the bottle.

Through the use of electrical fill control, means of this type make it possible to do without precision-calibrated springs. However, they also require the use of a great many mechanical moving parts, such as springs and sliding sleeves, which come into contact with the gas from the pressurized tank and with the liquid being bottled. Therefore, in the interests of hygiene, such means require that numerous seals be installed and that the delivery mechanism be washed frequently. In addition, given the force required for raising the sliding sleeves, it is necessary to connect the solenoid valve to a gas source with a pressure higher than that which prevails in the supply tank.

SUMMARY OF THE INVENTION

An object of the instant invention is therefore to produce filling means of the type using counterpressure, in which the commencement and cessation of the filling operation are electrically controlled, and in which the liquid being bottled does not come into contact with any mechanical moving part or with any seal.

Another object of the invention is to produce delivery means of the type described above, in which the sole source of pressurized gas is the pressure prevailing in the liquid supply tank.

The invention therefore comprises filling means operating by counterpressure and intended for use on bottling or filling machines, with said means consisting of a barrel equipped with an electric sensor for controlling the fill level in the containers and connected to a solenoid valve and supply tank filled with liquid under gaseous pressure, and to a detector that senses the proximity of the container to be filled, wherein the barrel of the filling means contains a chamber which, when no container is being applied against said filling means, is divided by two flexible membranes into three successive annular chambers separated by the dividing walls of the two membranes.

DETAILED DESCRIPTION OF THE PREFERRED EMBODIMENTS

Figure 1:
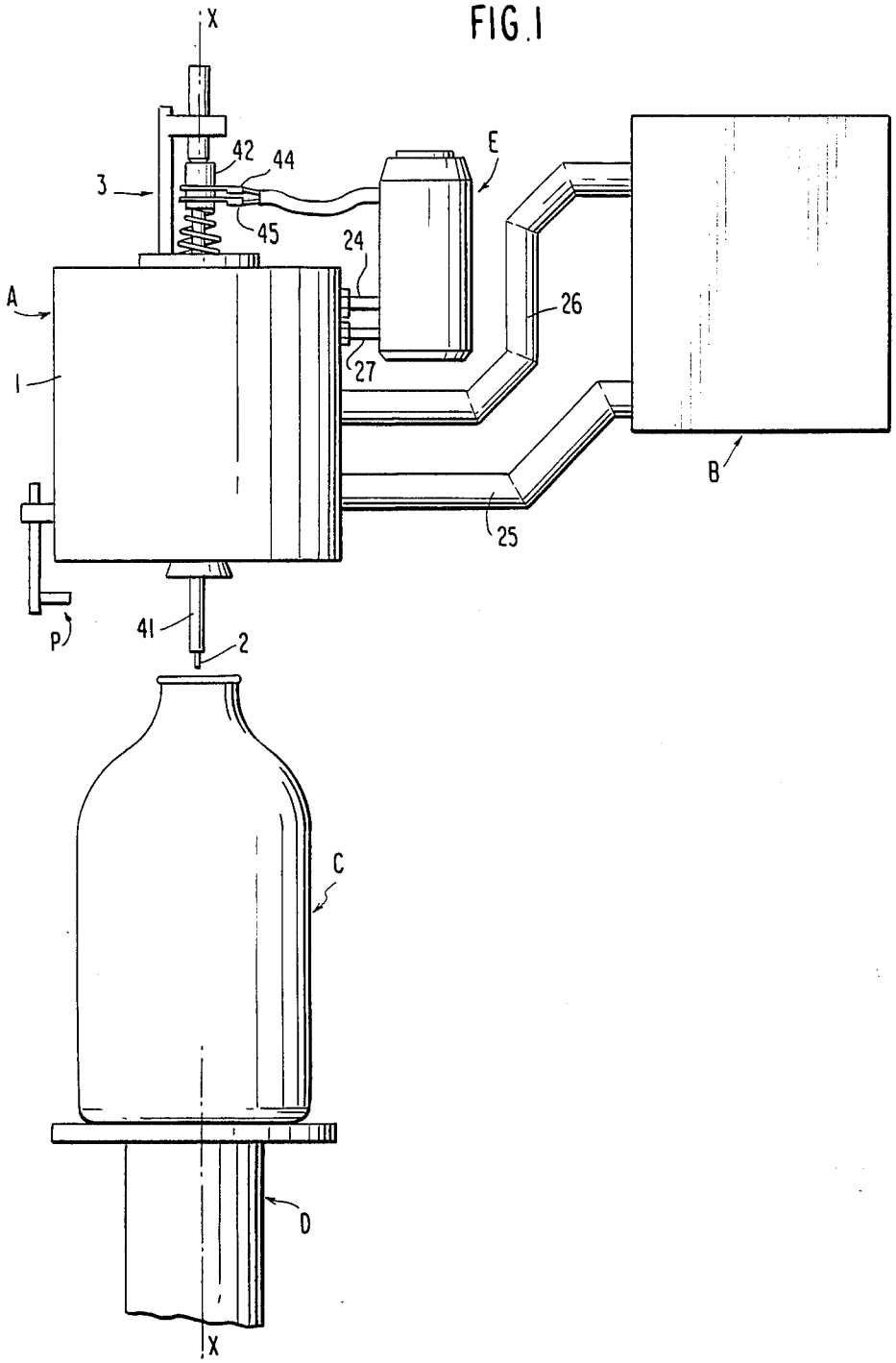
FIG. 1 is a schematic view of a filling unit equipped with the filling means of the invention.

According to the embodiment represented in FIG. 1, filling means A of the invention are intended to fill, from a supply tank B filled with liquid under gaseous pressure, a container C made of plastic or other material and supported by raising means D.

Figure 2:
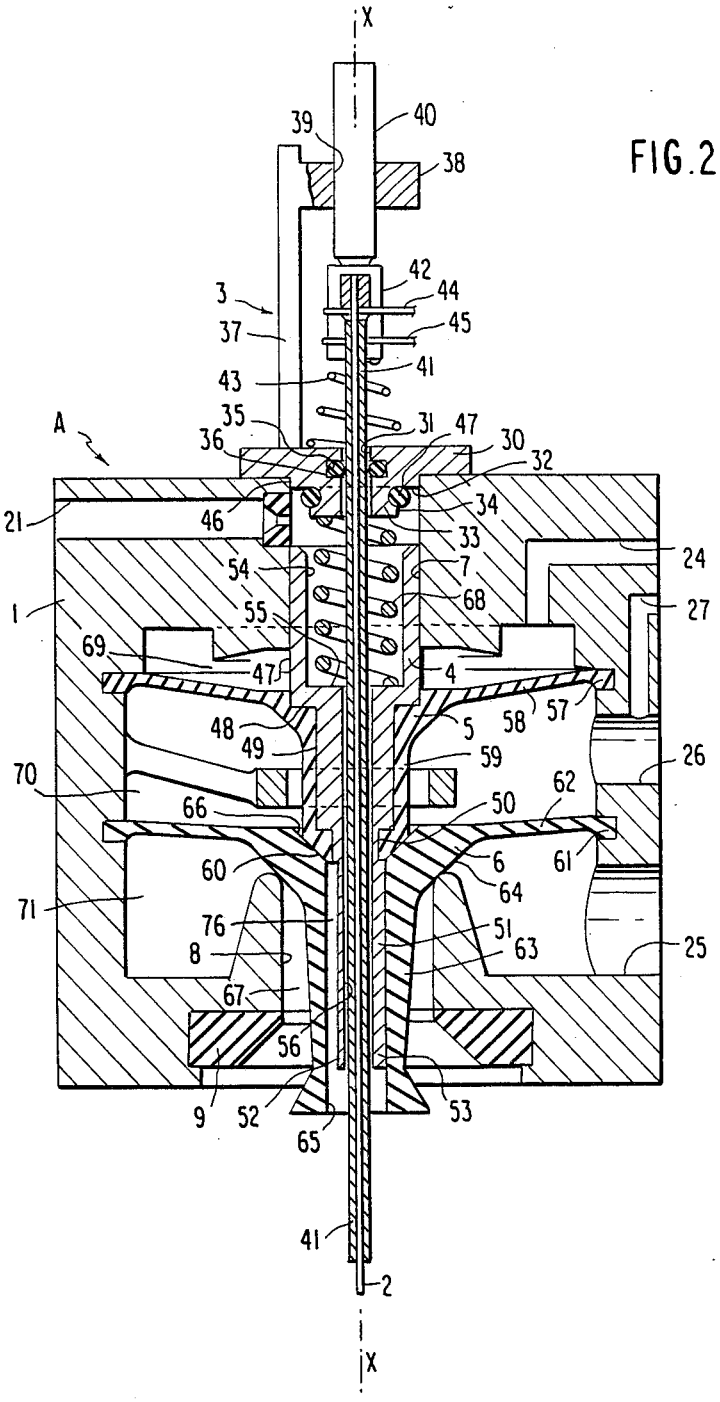
FIG. 2 is a sectional view of the filling means of the invention.

As illustrated in FIG. 2, filling means A of the invention consist of a barrel 1, cylindrical in shape and having axis X—X; an electrical sensor 2, coaxial with the barrel and passing entirely through it from top to bottom; means 3 for controlling the position of sensor 2 vis-a-vis barrel 1; a sleeve 4 having axis X—X and positioned within barrel 1; and two membranes 5 and 6 having axis X—X.

Figure 3:
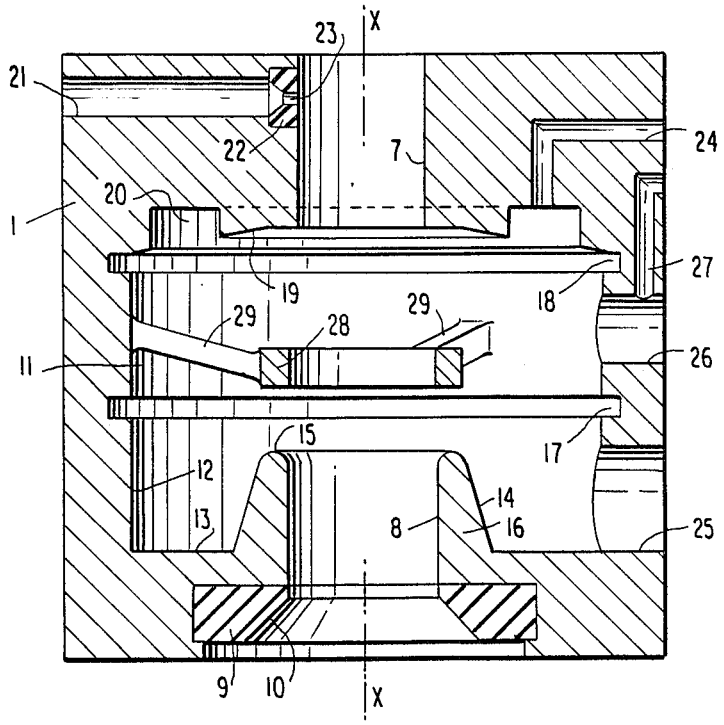
FIG. 3 is a sectional view of the barrel of the filling means of the invention.

As shown in FIG. 3, the upper end of barrel 1, which is cylindrical in shape and has vertical axis X—X, contains a cylindrical vertical conduit 7, also having axis X—X. The lower end of the barrel contains a second cylindrical vertical conduit 8, with axis X—X. The end of lower vertical conduit 8 closest to the base of barrel 1 terminates in a sealing gasket 9 having axis X—X. The gasket 9 has an internal conical surface 10 that converges in the direction of the top of the barrel. The minimum internal diameter of the surface 10 is less than or equal to the internal diameter of conduit 8.

The lower end of upper conduit 7, and the upper end of lower conduit 8, open into a chamber 11 enclosed by a cylindrical wall 12 having axis X—X.

The lower end of chamber 11 is delimited by an annular surface 13. In the embodiment illustrated in FIG. 3, the cross-section of surface 13 is straight, but it could equally well be curved. Toward the interior of chamber 11, i.e., toward axis X—X, surface 13 meets a surface of revolution 14 having axis X—X. In the same embodiment represented specifically in FIG. 3, surface 14 is conical and converges in the direction of the top of barrel 1. Thus, the upper portion of surface 14 joins the upper end of conduit 8 across an annular surface 15 which may be either flat or curved.

Surfaces 14, 15, and 8 thus form a wall 16. The elevation of surface 15 with respect to the base of barrel 1 is greater than the elevation of surface 13 with respect to the base of barrel 1.

Approximately midway up cylindrical wall 12 is an annular groove 17. The elevation of annular groove 17 with respect to the base of barrel 1 is greater than the elevation of annular surface 15 with respect to the base of barrel 1.

Close to its upper end, wall 12 contains a second annular groove 18.

The upper end of wall 12 is connected to the lower end of channel 7 by a ceiling 19 having axis X—X and forming the ceiling of chamber 11. In the embodiment depicted in FIG. 3, ceiling 19 has the shape of a surface of revolution which is conical and converges in the direction of the top of barrel 1.

An annular recess 20, with axis X—X, is provided in ceiling 19.

As shown specifically in FIG. 3, a conduit 21 is formed in the upper end of barrel 1 and opens into the upper end of conduit 7. Conduit 21 communicates with conduit 7 through a seal 22 containing an opening 23.

A second conduit 24 formed in the upper end of barrel 1 communicates with annular recess 20 in ceiling 19 of chamber 11. Two additional conduits 25 and 26 connect chamber 11 with the outside of barrel 1. Conduit 25 opens into chamber 11 through wall 12 between annular groove 17 and the bottom 13 of chamber 11. Conduit 26 passes through wall 12 and opens into chamber 11 between annular grooves 17 and 18. Conduit 26 also has a bypass 27 that also opens onto the outside of barrel 1.

In addition, a bearing ring 28, having axis X—X and located within chamber 11 opposite surface 15 at an elevation that is slightly greater with respect to the base of barrel 1 than that of annular groove 17, is connected to wall 12 of chamber 11 by arms 29.

As shown in FIG. 1, conduit 26 is connected to the upper part, and conduit 25 to the lower part, of supply tank B. Thus, conduit 26 is connected to the gas at pressure PO in the supply tank, whereas conduit 25 is connected to the liquid in supply tank B. Conduits 24 and 27 are connected to a solenoid valve E.

Finally, a detector P for sensing the proximity of container C to be filled is installed on filling means A of the invention. In the embodiment shown in FIG. 1, the proximity detector is fastened to barrel 1, but it might equally well be independent of barrel 1, being fastened, for example, to raising means D.

As can be seen more specifically in FIG. 2, means for adjusting the height of electric sensor 2 consist of a pedestal 30 having axis X—X and containing a vertical guideway 31 that is cylindrical in shape and has axis X—X. The lower surface 32 of pedestal 30 comprises a downward extension 33 that has axis X—X and is connected to surface 32 through lateral cylindrical surface 34. Extension 33, like pedestal 30, contains vertical guideway 31. Pedestal 30 is located at the upper nd of conduit 7 and is centered there by shoulder 46, the external diameter of which corresponds to the inner diameter of conduit 7. Shoulder 46 is formed in the lower surface 32 of pedestal 30. Cylindrical surface 34 is surrounded by a seal ring 47, the outer diameter of which is less than the inner diameter of conduit 7.

A toroid gasket 35 is set into a recess 36 formed in pedestal 30 on the cylindrical surface of vertical guideway 31.

Pedestal 30 has a bracket 37 with a horizontal arm 38 containing a hole 39 through which passes an adjusting rod 40.

The majority of electric sensor 2, with the exception of its lower tip, is contained within sheath 41. The upper end of sheath 41 is contained within and fastened to a support cap 42.

As can be seen specifically in FIG. 2, the upper surface of support cap 42 abuts the lower end of adjusting rod 40. A spring 43 presses simultaneously against the lower end of support cap 42 and the upper surface of pedestal 30.

Electric sensor 2 and sheath 41 pass through opening 31 in pedestal 30. Gasket 35 is applied against the outer surface of sheath 41.

The upper end of sensor 2 is connected to two electrical circuits 44 and 45 located in support head 42. These circuits connect electric sensor 2 with solenoid valve E.

Sleeve 4, a body of revolution with axis X—X, consists of an outer cylindrical surface 47 with an external diameter equal to the internal diameter of conduit 7, connected at the bottom, across a shoulder 48, to a second cylindrical surface 49 with an outer diameter that is less than the outer diameter of surface 47. Below cylindrical surface 49 is an anchoring surface shaped in the form of a constriction 50, followed, in the downward direction, by a guide structure 51 which may consist, as shown in FIG. 2, of a cylindrical body 52 having vertical longitudinal fins 53 over its outer surface.

Within, sleeve 4 has a cylindrical surface 54 of axis X—X, the height of which corresponds to that of surface 47. At its bottom, surface 54 connects, through an annular bearing surface 55, with a vertical cylindrical conduit 56 having axis X—X and a diameter that is greater than the outer diameter of sheath 41.

As can be seen with particular clarity in FIG. 2, surface 47 is intended to make sliding contact with the inner surface of conduit 7. In addition, when the filling means of the invention are at rest, the base of constriction 50 lies at a height (with respect to the base of barrel 1) that corresponds to the height of surface 15 (FIG. 3) (again with respect to the base of barrel 1). At rest, guide means 51 extend vertically from surface 15 of wall 16 to the base of seal 9.

Membrane 5, with axis X—X, is made of an elastomer or other ductile material. Its outer annular rim 57 is designed to lodge in annular groove 18 in cylindrical wall 12 of barrel 1.

Annular rim 57 extends toward axis X—X in the form of a divider 58 and stops at sleeve 4. In the embodiment illustrated in FIG. 2, the divider 58, when at rest, is conical in shape and converges downward in the direction of the base of barrel 1. The divider 58 is prolonged in the form of an anchoring barrel 59, which extends from the base of cylindrical surface 47 of sleeve 4 down to constriction 50. The shape of the inner surface of anchoring barrel 59 matches that of the outer surface of sliding sleeve 4 to which it is fastened.

The base of anchoring barrel 59, at the level of constriction 50, consists of a conical surface 60 that converges downward in the direction of the base of barrel 1.

Membrane 6, with axis X—X, is made of an elastomer or other ductile material. Its outer annular rim 61 is designed to lodge within annular groove 17 in cylindrical wall 12 of barrel 1.

Annular rim 61 extends toward axis X—X in the form of a divider 62. The lower surface of the base of divider 62 joins an external surface of a vertical barrel 63 (with axis X—X) through surface of revolution 64, which is conical in the embodiment shown in FIG. 2 and converges downward in the direction of the base of barrel 1.

Once assembled, the filling means possess an electric sensor 2 of axis X—X encased in a sheath 41, also of axis X—X, and passing through opening 31 in pedestal 30. The electric sensor then passes through conduit 7 and sliding sleeve 4, via conduit 56, emerging at the base of barrel 1 and extending below it.

Sleeve 4, which is integral with membrane 5 through anchoring barrel 59, shoulder 48 on cylindrical surface 49, and anchoring constriction 50, is mounted to slide along axis X—X within conduit 7, with the surface of conduit 7 making contact with outer cylindrical surface 47 of sleeve 4.

When membrane 6 is at rest, surface of revolution 64 of membrane 6 (the annular rim 61 of which is fastened to barrel 1) abuts surface 15 of wall 16 of barrel 1. The membrane 6, with axis X—X, surrounds guide means 51 of sleeve 4. The diameter of the vertical conduit 65 of axis X—X that is formed by the membrane is equal to or slightly greater than the outer diameter of the vertical longitudinal guide fins 53.

Thus, inner conduit 65 of membrane 6 and guide means 51 together form vertical longitudinal conduit 76, since the diameter of cylindrical barrel 52 of guide means 51 is less than the diameter of vertical longitudinal fins 53.

In addition, an annular space 67 is formed between the outer surface of barrel 63 and conduit 8 of barrel 1, since the outer diameter of barrel 63 is less than the inner diameter of conduit 8.

Finally, a spring 68, which presses against the lower surface of extension 33 of pedestal 30, and against the upper inside surface of sleeve 4, compresses conical surface 60 of membrane 5 against the corresponding conical surface 66 of membrane 6. Surface of revolution 64 of membrane 6 is in turn compressed against surface 15 of wall 16 of barrel 1.

When at rest, therefore, the filling means A of the invention present, from top to bottom, three annular chambers 69, 70, 71. The upper annular chamber 69 is bounded by ceiling 19 of chamber 11 and by the upper surface of divider 58 on membrane 5. The middle annular chamber 70 is bounded by the lower surface of divider 58 of membrane 5 and by the upper surface of divider 62 on membrane 6. The lower annular chamber 71 is bounded by the lower surface of divider 62 of membrane 6 and by surface 13 of chamber 11.

Figure 4:
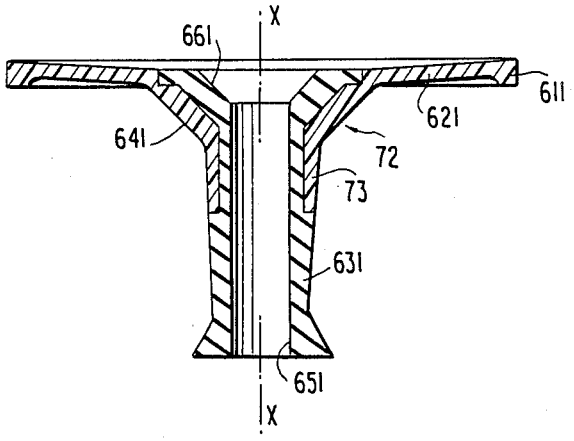
FIG. 4 is a sectional view of a variant of one element of the filling means of the invention.

According to a variant of the invention illustrated in FIG. 4, membrane 6 may be replaced with a membrane 72 having axis X—X and an annular rim 611 anchored in groove 17 of barrel 1. Annular rim 611 extends toward axis X—X in the form of a divider 621. The divider is made integral with sliding barrel 631 of axis X—X, which contains an inner cylindrical conduit 651 having axis X—X, the diameter of which corresponds to the diameter of conduit 65 of barrel 63. The upper end of conduit 651 terminates in conical surface 661, which converges downward in the direction of the base of barrel 1 and corresponds to conical surface 66 of membrane 6.

Thus, the upper surface of membrane 72 would be connected with conical surface 661 of sliding barrel 631, and the lower surface of membrane 72 would be connected with the outer surface of sliding barrel 631 through an extension 73 of membrane 72, said extension being a surface of revolution with axis X—X, the inner face of which serves an anchoring function. Around the upper periphery of sliding barrel 631, extension 73 of membrane 2 comprises an external surface of revolution 641 having axis X—X. The surface 641 joins together the outer surface of barrel 631 and the lower surface of divider 621 of membrane 72. The shape of the surface of revolution 641 corresponds to the shape of surface 64 of membrane 6 and is thus designed to make contact with the upper surface 15 of wall 16.

OPERATION

Raising means D, which may consist of a simple saddle, bring the mouth of the container to be filled, C, which may be a bottle made of plastic or another material, up against conical surface 10 of seal 9 on barrel 1. Surface 10 also serves to center the rim of the container C being filled.

Figure 5:
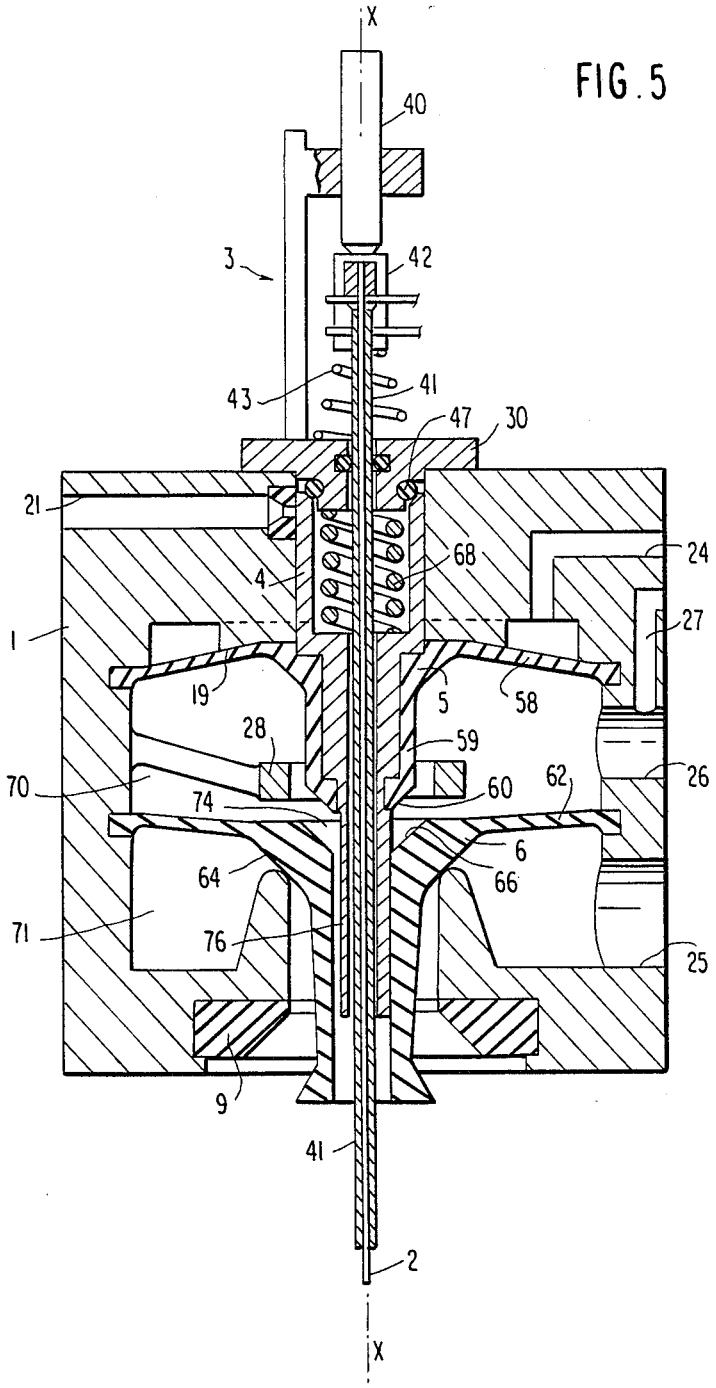
FIGS. 5 through 7 are sectional views of the filling means of the invention, illustrating various stages in the process of filling a container.

Proximity detector P is then excited, thereby activating solenoid E. Through conduit 24, solenoid E reduces the pressure prevailing in annular chamber 69. Because annular chamber 70 is connected via conduit 26 to the tank of pressurized gas, set at pressure PO, said chamber 70 is also at pressure PO. A pressure differential is thus established on either side of membrane 5. When the pressure differential reaches a preset value that is sufficient to compress spring 68, membrane 5 begins to move upward, drawing sleeve 4 with it. The vertical movement ends when divider 58 of membrane 5 reaches ceiling 19 of chamber 11 (FIG. 5).

At that point, conical surface 60 of membrane 5 is no longer in contact with conical surface 66 (or 661) of membrane 6 (or 631), thus forming an annular space 74.

Furthermore, the rise of sleeve 4 causes its upper end to form a leakproof seal with gasket 47 on pedestal 30. From that point forward, there is no communication between conduit 21 and the interior of sliding sleeve 4.

The gas contained in annular chamber 70 may then move through space 74 and channels 76 into the container to be filled. Because the gas pressure levels inside the container and the supply tank are regulated by solenoid E through conduit 27, the gas in the container to be filled may reach a pressure Pl that is equal to the constant pressure PO prevailing above the liquid in supply tank B.

Figure 6:
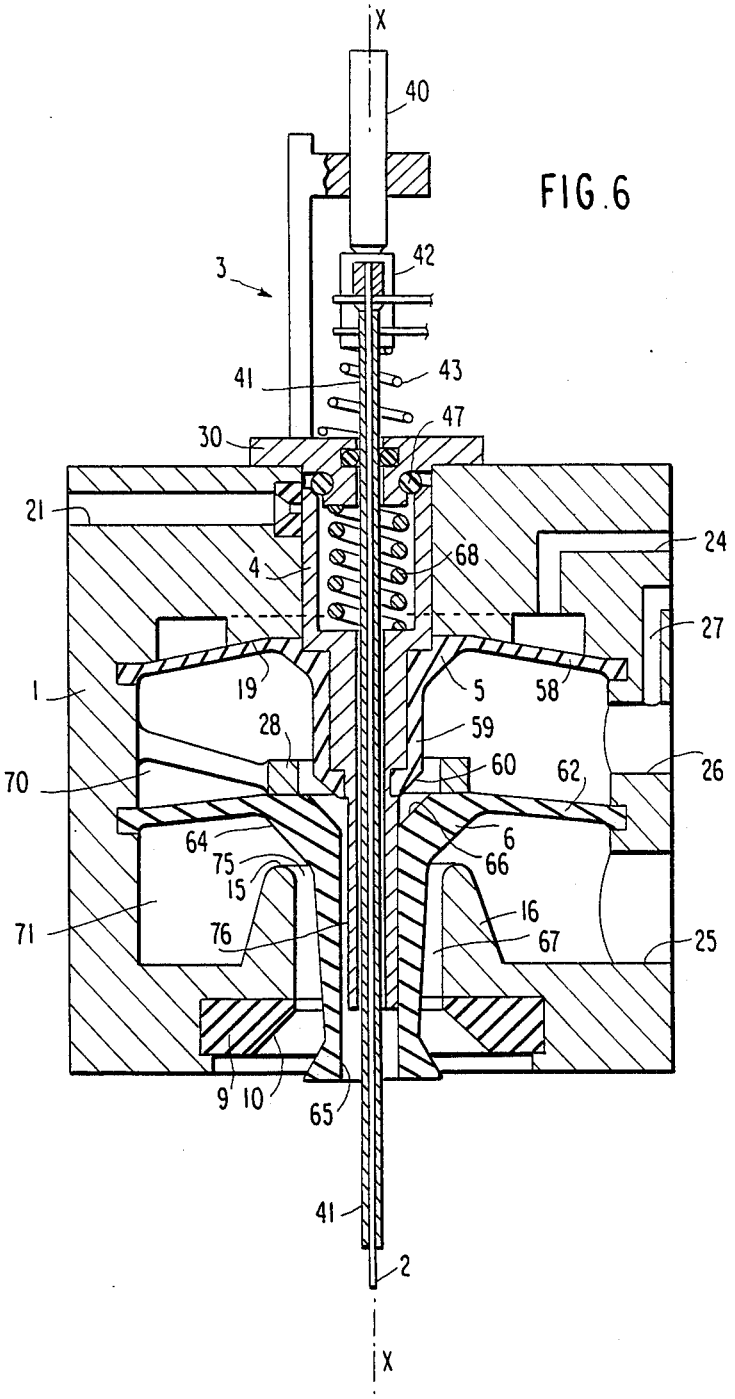

Meanwhile, on the surface of membrane 6 in annular chamber 71, the prevailing pressure is equal to PO plus (the additional pressure exerted by) the height of liquid H between the level of liquid in the pressurized tank and the level of divider 62 of membrane 6. A pressure of PO prevails over the rest of membrane 6. Thus, as a result of the pressure difference between the pressurized tank and the delivery means, membrane 6 (or membrane 72 and barrel 631) rise off surface 15, so that surface 64 (or surface 641) is no longer in contact with surface 15 (FIG. 6).

Bearing ring 28 in chamber 11 limits the rise of membrane 6 so that surface 60 of membrane 5 does not make contact with surface 66 (or surface 661) of membrane 6 (or barrel 631). Bearing ring 28 is situated at a point inside annular chamber 70 that is opposite surface 15 and above membrane 6 (or 72).

An annular opening 75 (FIG. 6) is thus created between surface 64 (or 641) and surface 15 on wall 16.

The liquid from supply tank B that is contained in annular chamber 71 may then pass through annular channel 67 into the bottle to be filled, forcing the gas contained in the bottle through channels 76 and into chamber 70, with solenoid E maintaining constant pressure.

When the liquid inside the bottle reaches the base of sensor 2, the sensor reverses the operation of solenoid E by means of electrical circuits 44 and 45, thus causing pressurized gas to enter chamber 20 through conduit 24 and force down membrane 5 and sliding sleeve 4. After surface 60 makes contact with surface 66 (or 661), the descent of membrane 5 and sleeve 4 continues, forcing down membrane 6 (or membrane 72 and barrel 631).

Figure 7:
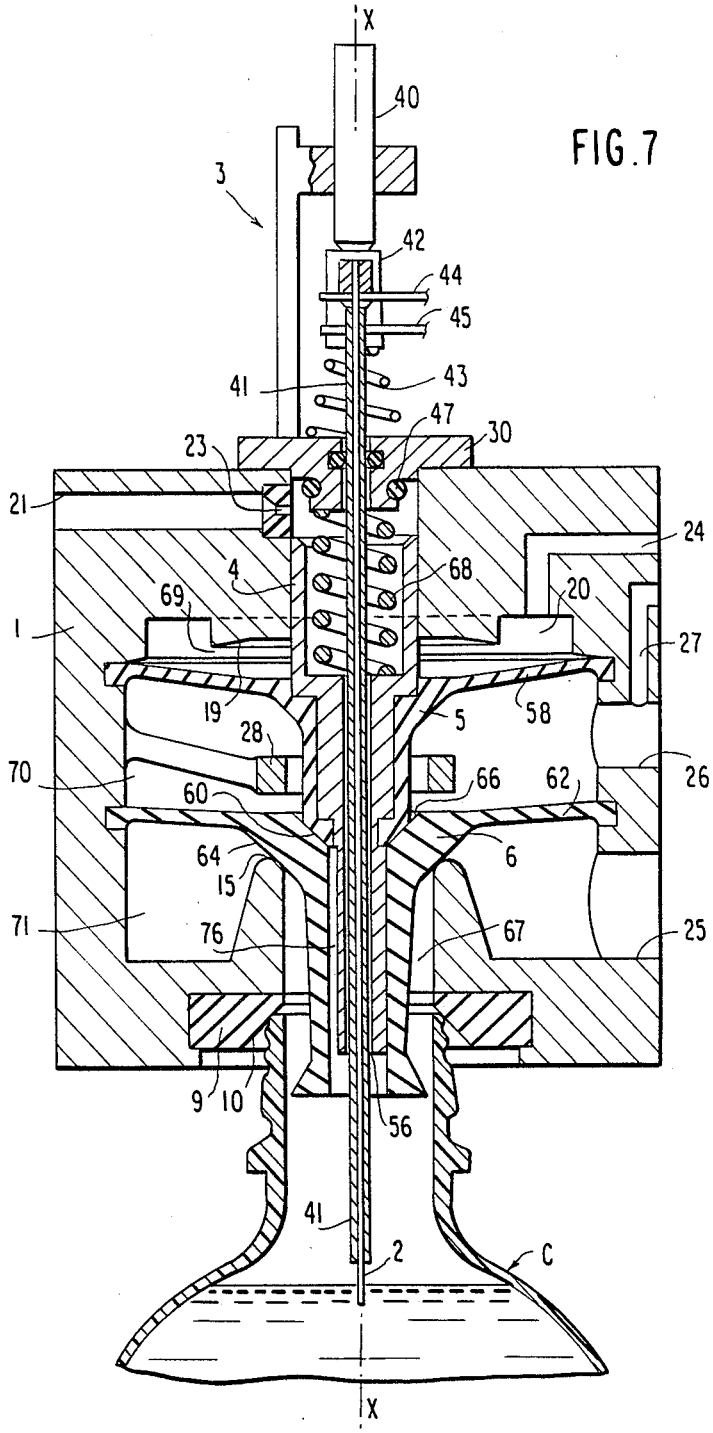

Surface 64 (or 641) of membrane 6 (or 72) finally makes contact with surface 15 on wall 16 (FIG. 7).

The valves supplying the bottle with liquid and pressurized gas are then closed and the filling operation is complete.

The drop of sleeve 4 unblocks opening 23 in conduit 21 so that the pressurized gas contained in the container being filled may escape by way of conduit 56, conduit 7, opening 23 in gasket 22, and, finally, conduit 21. The bottle is thereby returned to atmospheric pressure and a new filling cycle involving a new container may begin.

Using vertical adjustment means 3, the depth to which sensor 2 enters the container C may be adjusted, enabling the fill level of container C to be easily modified.

The invention thus provides a simple means of filling a container using counterpressure, without allowing the liquid being delivered to come into contact with any seals or moving mechanical parts.

What is claimed is:

1. A counterpressure filling apparatus for use on bottling or filling machines to fill a container, comprising:

a supply tank (B) for storing liquid under gaseous pressure;

filling means (A) for injecting said liquid into said container (C) when said container is disposed in an operative position with respect to said filling means, said filling means including a barrel (1) having a first chamber (11) defined therein, and a sensor (2) for issuing a first output when an amount of said liquid injected into said container reaches a predetermined amount;

de-actuation means, responsive to said first output of said sensor, for de-actuating said filling means; and first and second flexible membranes (5, 6 or 72) disposed in said barrel and having first and second walls (58, 62 or 621), respectively, for dividing said first chamber into second, third and fourth successive chambers (69, 70, 71) prior to injection of said liquid into said container, wherein the filling apparatus further comprises a detector (P) for issuing a second output when said container is in said operative position, and said de-actuation means is responsive to said second output of said detector for actuating said filling means.

2. The filling apparatus of claim 1, wherein said de-actuation means includes a solenoid valve (E).

3. The filling apparatus of claim 2, wherein said first chamber is annular, and said second, third and fourth successive chambers are annular.

4. the filling apparatus of claim 3, wherein said tank includes means for storing the liquid in one section, and pressurized gas in another section, and said filling apparatus further comprises: a first conduit (24) for connecting said second annular chamber (69) to said solenoid valve (E); a second conduit (26) for connecting said third annular chamber (70) to the section of said tank containing the pressurized gas; and a third conduit (25) for connecting said fourth annular chamber (71) to the section of said tank containing the liquid.

5. The filling apparatus of claim 4, further comprising a bypass (27) for connecting said second conduit (26) to said solenoid valve (E).

6. The filling apparatus of claim 5, wherein said filling means further comprises a bearing ring (28) and arms (29) for connecting said bearing ring to a wall (12) of said first chamber.

7. The filling apparatus of claim 6, wherein said bearing ring (28) is located within said third annular chamber (70) between said first and second membranes, said barrel having a surface which is disposed between the container when it is in the operative position and said second membrane, said surface having a conical portion (14) which projects and converges toward said second membrane and has an annular end portion (15), said bearing ring being further disposed opposite to the said annular end portion.

8. The filling apparatus of claim 3, wherein said barrel further comprises a cylinder having a central axis, and said filling means further includes a sleeve (4) connected to said first membrane and disposed in said barrel for slidable movement along said central axis.

* * * * *